US010207861B2

(12) United States Patent
Beyer et al.

(10) Patent No.: US 10,207,861 B2
(45) Date of Patent: Feb. 19, 2019

(54) PRODUCT PACKAGING FOR A SOLID PRODUCT BLOCK

(71) Applicant: Ecolab USA Inc., Saint Paul, MN (US)

(72) Inventors: Sarah Beyer, Dusseldorf (DE); Henner Thoss, Hertzogenrath (DE); Christoph Maul, Dusseldorf (DE); Dirk Kullwitz, Tonisvorst (DE)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 15/219,093

(22) Filed: Jul. 25, 2016

(65) Prior Publication Data

US 2016/0332807 A1 Nov. 17, 2016

Related U.S. Application Data

(63) Continuation of application No. PCT/EP2013/074692, filed on Nov. 26, 2013.

(51) Int. Cl.
*B65D 85/804* (2006.01)
*B65D 43/02* (2006.01)

(52) U.S. Cl.
CPC ..... *B65D 85/8043* (2013.01); *B65D 43/02* (2013.01)

(58) Field of Classification Search
CPC ..... B65D 85/804; B65D 85/70; B65D 43/02
USPC ..... 220/256.1
See application file for complete search history.

(56) References Cited

U.S. PATENT DOCUMENTS 4,426,362 A 1/1984 Copeland et al.
5,573,698 A * 11/1996 Mandler ..... A47L 15/4436 206/503
5,785,428 A * 7/1998 Mazzocchi ..... B65D 33/01 383/103
6,036,038 A * 3/2000 Lovelace ..... B65D 81/22 206/804
2009/0312698 A1* 12/2009 Farrell ..... A61M 25/0009 604/95.04
2010/0139695 A1 6/2010 Wiedemann et al.
(Continued)

FOREIGN PATENT DOCUMENTS

JP 60131564 U 9/1985
JP 61143092 A 6/1986
JP 2002068304 A 8/2002

OTHER PUBLICATIONS

Ecolab Inc., PCT/EP2013/074692 filed Nov. 26, 2013 "Written Opinion of the International Searching Authority" dated Jul. 28, 2014, 6 pages.

(Continued)

*Primary Examiner* — Steven A. Reynolds
*Assistant Examiner* — Javier A Pagan
(74) *Attorney, Agent, or Firm* — McKee, Voorhees & Sease, PLC

(57) ABSTRACT

Packaging concepts include a product packaging (10) for a solid product block (14), in particular for a dispenser system. The packaging includes a wrapping (12) comprising a top (16), sides (20), and a bottom (18), forming a cavity with an opening (22) configured and arranged to receive the solid product block (14), a mesh (26) covering the opening (22) fluid-permeable, and a lid (28) attached removably to the mesh (26) in a closed position for sealing the opening (22) of the wrapping means (12). The product packaging (10) improves the safe handling of the solid product block (14).

8 Claims, 3 Drawing Sheets

(56) References Cited

U.S. PATENT DOCUMENTS

| | | | | |
|---|---|---|---|---|
| 2011/0123697 | A1* | 5/2011 | Patterson | B65D 81/22<br>426/394 |
| 2012/0061402 | A1* | 3/2012 | Waterston | A21B 3/155<br>220/573.1 |

OTHER PUBLICATIONS

"Water Solumble Polymer Makes Its Debut", (retrived from internet on Oct. 23, 2017), https://www.plastictoday.com/content/water-solumble-polymer-makes-its-debut/88075069010167, published on Aug. 22, 2008.

* cited by examiner

PRODUCT PACKAGING FOR A SOLID PRODUCT BLOCK

TECHNICAL FIELD OF THE INVENTION

This invention relates generally to product packaging. More particularly, this invention relates a product packaging for a solid product block, in particular for a dispenser system.

BACKGROUND OF THE INVENTION

Solid products are usually dispensed in so product dispensers, for example by spraying or flushing with water, to create a use solution. Some solid products are caustic or corrosive and should be handled without coming into direct contact with the solid product. This is particularly true in industrial laundry, wear washing and floor care products.

To package solid products, shrink wrapped foils are commonly used. Small holes in the foil allow an evacuation of otherwise trapped air during the shrinking of the film as the film shrinks to conform to the shape of the solid product. Through these small holes, moisture from the atmosphere might enter the package, which may cause a solid product to swell and at least partially dissolve. This may lead to a user, a person handling the product, getting into direct contact with the solid product that has escaped through the shrink wrapped foil. Thus, it is challenging to load solid product into a dispenser without getting into contact with the solid product. Also a removal of a solid product from a dispenser, for example in case of a blockage of the dispenser, is not possible with this type of packaging without the user getting into direct contact with the solid product.

SUMMARY OF THE INVENTION

It is therefore an object of the present invention to provide a product packaging for holding a substance, preferably a solid product in form of a solid product block, which enables a save handling of the product, in particular when loading or unloading the substance from a dispenser, without the risk of the user getting into direct contact with the substance.

This object is solved by a product packaging according to claim 1 of the present invention. Preferred embodiments, additional details, features, characteristics and advantages of the object of the invention of said product packaging are disclosed in the sub-claims.

Accordingly, a product packaging for a solid product block, in particular for a dispenser system, comprises a wrapping means comprising a top, sides, and a bottom, forming a cavity with an opening configured and arranged to receive the solid product block, a mesh covering the opening fluid permeable, and a lid attached removably to the mesh in a closed position for sealing the opening of the wrapping means.

The wrapping means may be formed of a rigid material, which allows for forming the wrapping means into its final shape, for example according to the solid product block, independently from and prior to receiving the solid product. The wrapping means comprises an opening configured and arranged to receive the solid product block, wherein the size of the opening may at least match the size of the solid product block to be received. The opening may be closed after the solid product block has been placed inside the wrapping means. The opening may be closed for example by welding the material of the wrapping means together. The closed opening may be reopened prior to use or automatically when placing the product packaging with the solid product block inside a dispenser. The opening is covered by a mesh, through which a fluid, for example water, for dissolving the solid product block may get into contact with the solid product. The dissolved solid product may, for example in form of a use solution, exit the wrapping means through the opening and the mesh covering the opening. The mesh and/or the lid may be formed integrally with the wrapping means. The opening of the wrapping means may be covered by a lid, which may be removed prior to using the solid product. The lid may be formed from a material like plastic or aluminium foil. The lid may be attached removably to the mesh in a closed position of the product packaging sealing the opening of the wrapping means.

By using a wrapping means comprising an opening configured and arranged to receive the solid product block it is possible to use a fluid impermeable material for the wrapping means, thus avoiding any contact of a user with the solid product or the dissolved solid product on the outside of the wrapping means. Further by providing a mesh which is covering the opening of the wrapping means, the solid product may be prevented from falling out of the wrapping means, as it is held back by the mesh. Further, using a lid attachable to the mesh allows for keeping the solid product enclosed prior to use, thus avoiding any contact of a user with the solid product block. Thus, the product packaging according to the invention has the advantage that the risk of a user handling the product packaging and the solid product getting into contact with the substance of the solid product block, in particular when loading or unloading a dispenser, is significantly reduced.

According to a preferred embodiment of the invention, the mesh is a flexible foil or a rigid thermoplastic. The mesh in form of a flexible foil may be formed integrally with a wrapping means in form of a foil. The foil may be a fluid impermeable shrink wrapped foil, as any air trapped inside the wrapping means during the shrinking may escape through the mesh. Thus, a cost-efficient way of enclosing the solid product block may be used and at the same time avoiding a person handling the solid product block from getting into contact with the dissolved product, for example at the outside of the wrapping means. The mesh may also be formed in form of a rigid thermoplastic mesh, wherein the mesh made of a rigid thermoplastic has the advantage that the shape of the mesh does not change with a progressing solution of the solid product block.

According to an embodiment of the invention the mesh is generated by laser cutting, in particularly in an assembled position of the mesh attached to the wrapping means. The mesh is generated by laser cutting wherein the material the mesh is formed from may be attached to the wrapping means before, during or after the solid product tock has been inserted into the wrapping means and/or enclosed by the wrapping means. The material the mesh is generated from may be a foil or a thermoplastic part into which the fluid permeable openings of the mesh are cut into laser beam. This has the advantage of an efficient production process, as the size and shape of the mesh are generated according tool-less and according to the product which is being produced at the time.

According to an embodiment of the invention the wrapping means comprises a flange for attaching the mesh and/or the lid. The flange may surround at least part of the opening of the wrapping means, wherein the flange may extend from the sides, in particular radially outwards. The flange may form a sealing area, which may be at least partially arranged in parallel to a surface of the solid product block. The surface the sealing area may be arranged in parallel to may be arranged next to the opening of the wrapping means. The mesh and or the lid may be attached to the flange, in particular the sealing area. When the lid is attached to the flange, in particular the sealing area, the mesh may be arranged inside the opening of the wrapping means. The flange has the advantage that the mesh and/or the lid may be securely attached to the wrapping means.

According to an embodiment of the invention the wrapping means is a foil, in particular an at least partially fluid soluble foil, or a thermoformed plastic. A wrapping means in form of a foil has the advantage that the solid product block may be wrapped in a cost-efficient way. A further advantage is that the same foil may be used to wrap solid product blocks of different shapes and sizes. The wrapping means in form of an at least partially fluid, e.g. water, soluble foil may be designed in a way, that for example the lid and/or the opening may be removed or reopened by dissolving an according part of the wrapping means. The wrapping means may be at least partially dissolved by spraying and/or flushing the wrapping means with the fluid used for dissolving the solid product block, for example water. This has the advantage that the solid product block may be safely packed for handling without the need for opening the product packaging prior to loading it into a dispenser for example, as the necessary openings, i.e. the lid and/or opening, are removed and/or reopened automatically when the product packaging is first getting into contact with the fluid for dissolving the solid product block. This may be after loading a product packaging containing a solid product block into a dispenser and starting the spraying and/or flushing operation. A wrapping means in form of a thermoformed plastic has the advantage that the wrapping means may be moulded or formed by deep drawing prior to placing the solid product block inside the wrapping means. Also the wrapping means may provide for a very rigid encasing of the solid product, which has the advantage that the wrapping means may keep its shape during the dissolving of the solid product block. This allows for a save removal of the product packaging even with remaining solid product inside.

According to an embodiment of the invention the opening, the mesh and the lid are located at the top and/or bottom of the wrapping means. The opening the mesh and/or the lid may be located in the same or different places of the wrapping means. The opening with the mesh and the lid may both for example be arranged at the bottom of the wrapping means, thus allowing for the solid product block being sprayed with water from the bottom through the mesh. An arrangement of an opening and the lid at the top as well as at the bottom together with a mesh at the bottom would, for example, allow water to enter at the top of the wrapping means for dissolving the soluble solid product block in order to form a use solution, wherein the use solution may exit the wrapping means through the opening and the mesh arranged at the bottom of the wrapping means.

According to an embodiment of the invention the mesh located at the bottom of the wrapping means is designed in form of a product carrier comprising at least one handling means. The mesh in form of the product carrier may be designed to accommodate the solid product block in an undissolved state, wherein the weight of the solid product block may be supported by the mesh. The at least one handling means may extend at least partially along the side to the top of the wrapping means, for example from the mesh at the bottom of the wrapping means to the top of the wrapping means. The handling means may extend in a vertical direction beyond a top surface of the solid product block, in order to allow a user use the handling means for handling the solid product block without getting into direct contact with the product block. In a closed state of the wrapping means the opening as well as the mesa in form of a product carrier with the at least one handling means may be covered by the lid. The lid may be arranged at the top or at the bottom of the wrapping means. In an opened state, wherein the lid has been removed, a person may handle the solid product block by means of the at least one handling means, thus avoiding getting into direct contact with the solid product block. With the lid arranged at the top of the wrapping means, the user may, after removing the lid, remove the solid product block from the wrapping means by lifting the mesh in form of the product carrier out of the wrapping means, wherein the solid product block rests on the product carrier.

According to an embodiment of the invention the at least one handling means comprises a hook-shaped end. The hook-shaped end of the handling means has the advantage that the product package may easily be hung into a dispenser. The hook-shaped end of the handling means may be arranged at the end of the handling means opposite to the mesh in form of the product carrier on which the solid product block is resting. A second handling means, in particular also comprising a hook-shaped end, may be arranged opposite to the first handling means in order to allow a safe handling of the solid product block, for example by enabling the operator to hold one handling means in each hand. Also two opposing handling means allow for a save positioning of the product carrier inside a dispenser.

The product carrier with the at least one handling means also has the advantage that a person may safely remove the product carrier together with any remaining solid product from a dispenser without getting it to direct contact with the product.

According to an embodiment of the invention the mesh and/or the lid are formed integrally with the wrapping means. The mesh may be formed integrally with the wrapping means for example by cutting the mesh into the material of the wrapping means. This has the advantage, the mesh may be produced in a cost-efficient way. The lid may be integrated into the wrapping means by wrapping the solid product block in a foil, wherein the part of the wrapping means forming the lid is a fluid soluble foil. The part of the wrapping means made of fluid soluble foil and forming the lid may be dissolved by spraying and/or flushing with the fluid used for dissolving the solid product block after placing the product packaging inside a dispenser and staring the operation of the dispenser, thus dissolving the soluble part of the wrapping means and removing the lid and making the opening accessible. The fluid soluble part of the wrapping means may be arranged next to the mesh of the wrapping means. This has the advantage that an user may place the product packaging directly into a dispenser without having to remove the lid, as the lid is removed by dissolving as soon as the spraying of the solid product block or rather the spraying starts by the dispenser. Thus, a person does not get into direct contact with the solid product block.

A further aspect of the invention is a dispenser system for dispensing a soluble solid product block comprising at least one product packaging as previously described.

The afore-mentioned components, as well as the claimed components and the components to be used in accordance with the invention in the described embodiments, are not subject to any special exceptions with respect to their size, shape, material selection and technical concept such that the selection criteria known in the pursuant field can be applied with a limitation.

BRIEF DESCRIPTION OF THE DRAWINGS

Additional details, features, characteristics and advantages of the object of the invention are disclosed in the sub-claims, the figures and the following description of the respective figures and examples, which—in exemplary fashion—show several embodiments and examples of a product packaging according to the invention.

In the drawings.

The present invention may be used with any solid product in form of a solid product block. It is understood that the phrase solid product includes solid products, substantially solid products, semi solid products, and the like. If the solid product is in a shaped form, such as a block, the solid product may be formed in any desired manner including cast methods, extrusion and pressed powder. A solid product may be formulated for a variety of uses such as, but not limited to, a wear washing detergent, a wear washing aid, a vehicle care detergent such as in a car wash, a medical instrument detergent, a clean in place cleaner, a floor cleaner and the like. The solid product may include a variety of different chemicals including acids, bases, hardening agents, sequestering agents, surfactants, builders, enzymes, dies, fragrances and the like.

Figure 1:
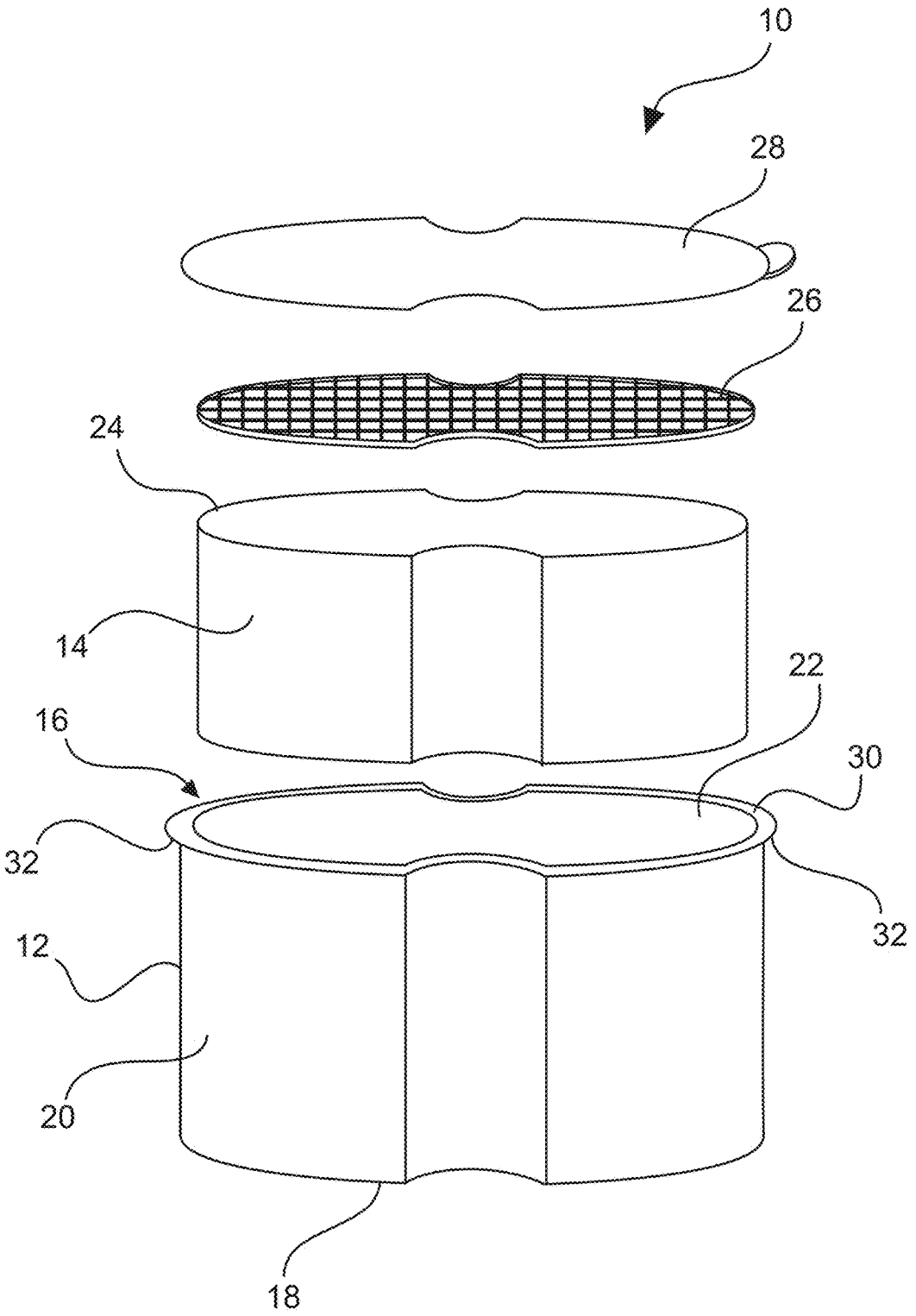
FIG. 1 shows a schematic perspective of a product packaging in a disassembled state.

The illustration in FIG. 1 shows a product packaging 10 in a disassembled state, wherein the product packaging 10 comprises a wrapping means 12 for holding a solid product block 14. The wrapping means 12 comprises a top 16 which is connected to a bottom 18 by sides 20. The wrapping means 12 forms a cavity into which the solid product block 14 may be accommodated. Further, the wrapping means 12 comprises an opening 22, which is arranged at the top 16 of the wrapping means 12, wherein the opening 22 is configured and arranged to receive the solid product block 14. The solid product block 14 comprises a top surface 24 which is arranged next to the opening 22 in an assembled state of the product packaging 10. In an assembled state of the product packaging 10 the opening 22 of the wrapping means 12 is covered fluid-permeable by a mesh 26, wherein the mesh 26 is arranged next to the top surface 24 of the solid product block 14. For sealing the opening 22 and the mesh 26 fluid-impermeable, in order to avoid any fluid, in particular water, to get into contact with the solid product block 14, for example during the transport of the product packaging 10, the opening 22 and the mesh 26 are sealed by a lid 28, which is attached to the mesh 26 and/or a sealing area 30 of the wrapping means 12. The mesh 26 is arranged inside the opening 22, wherein the lid 28 is directly attached to the sealing area 30 of the wrapping means 12. The sealing area is designed in form of a flange 32 which is arranged at the top 16 of the wrapping means 12 and extends radially outward in order to form a sufficient sealing area 30 for attaching the mesh 26 and/or the lid 28. The flange 32 and the sealing area 30 extend along the sides 20 of the wrapping means 12. The wrapping means 12 may be made of a thermoplastic material, which may be formed by deep drawing, and provides a rigid wrapping means 12 that keeps it shape during the dissolving of the solid product block 14. Also the mesh 26 may be designed in form of a thermoplastic mesh, providing a stable mesh for holding back any solid product not yet dissolved.

Figure 2:
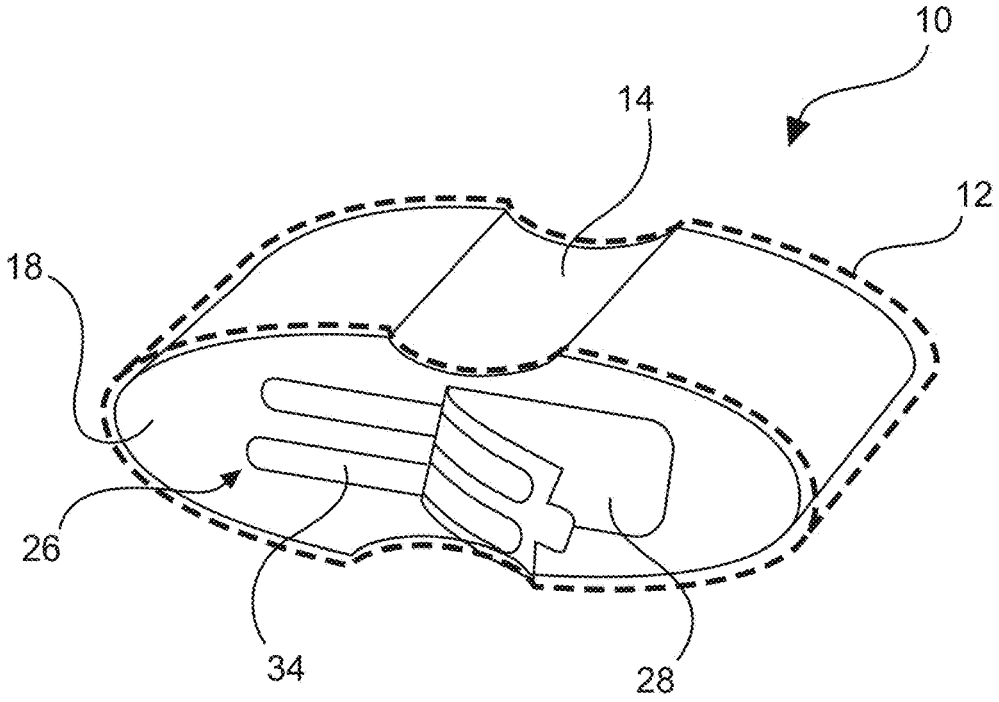
FIG. 2 shows a schematic perspective of a wrapped solid product block.

The product packaging 10 illustrated in FIG. 2 shows a solid product block 14 which has been enclosed by a wrapping means 12 in form of a foil. The product packaging comprises a mesh 26 at the bottom in form of two elongated slits 34, which are covered by a lid 28, which is shown in a partially removed state. The mesh 26 is formed integrally with the wrapping means 12 and may be generated by laser cutting, for example by cutting the elongated slits 34 into the material of the wrapping means 12 after the solid product block 14 has been wrapped into the wrapping means 12.

Figure 3:
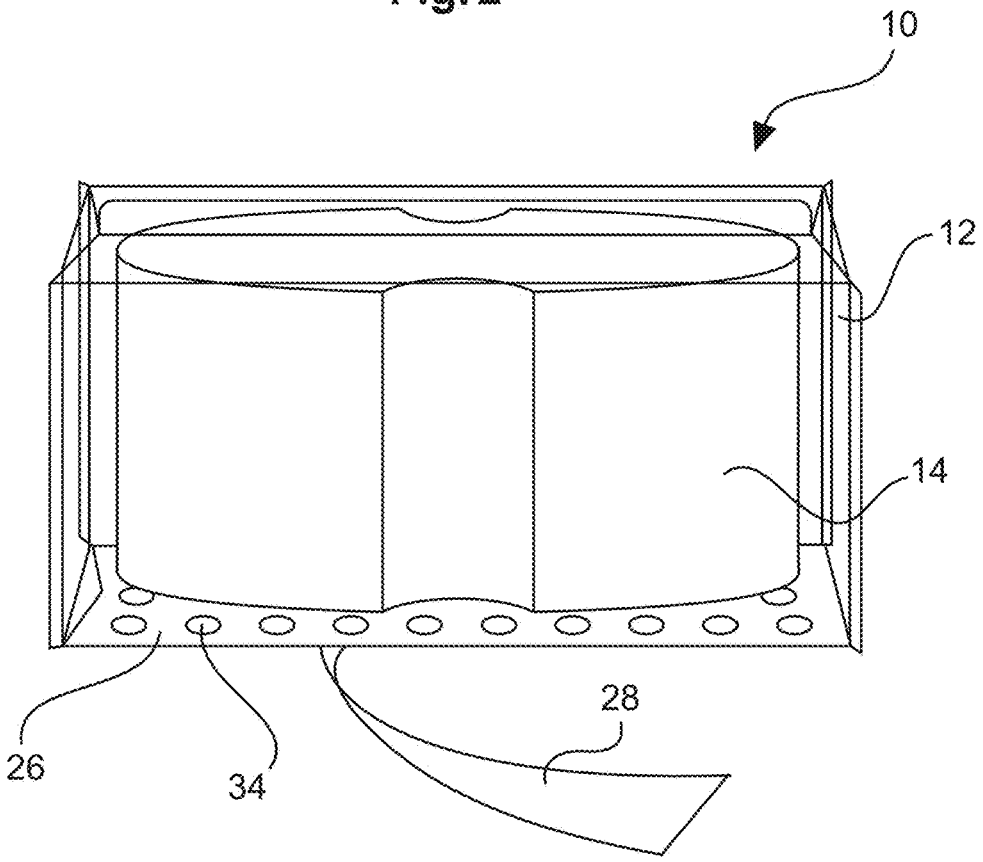
FIG. 3 shows an illustration of a product packaging with a partly removed lid.

A solid product block 14 being enclosed in a wrapping means 12 also in form of a foil is displayed in FIG. 3. The mesh 26 comprises a number of mesh openings 34 designed in form of holes, wherein the mesh is sealed by a lid 28 in form of a foil, wherein the lid 28 is displayed in a partially removed state.

Figure 4:
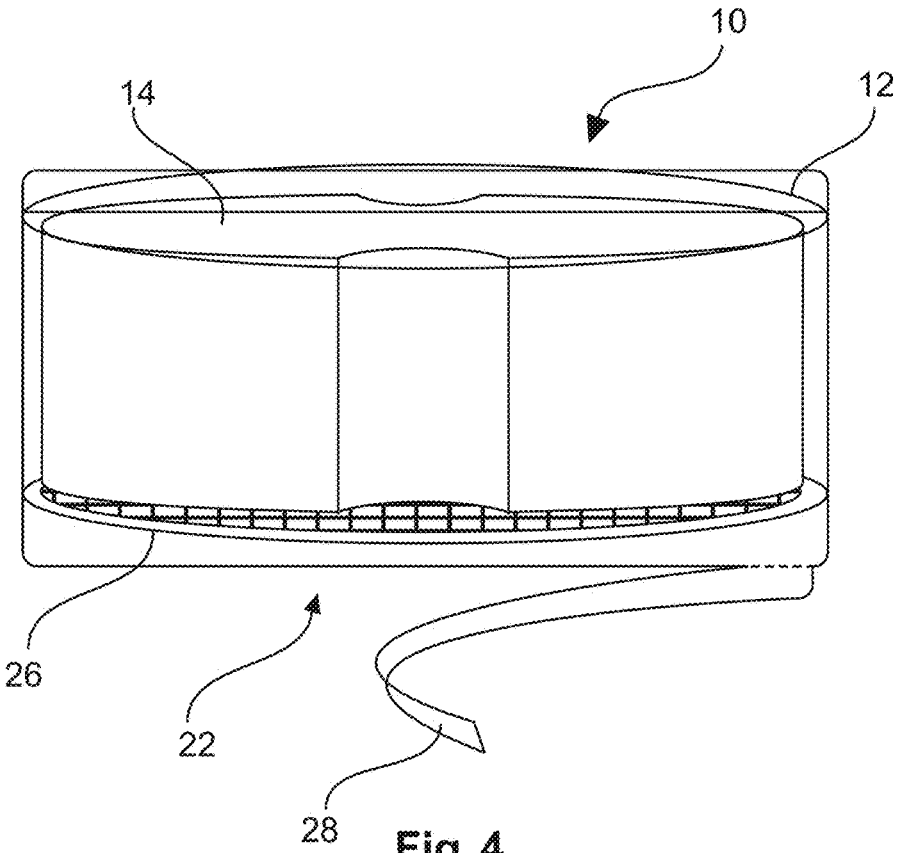
FIG. 4 illustrates a product packaging with a mesh formed from thermoplastics.

FIG. 4 displays a product packaging with a wrapping means 12 in form of a foil enclosing a solid product block 14. The mesh 26 in form of a rigid thermoplastic mesh is arranged inside the opening 22 of the wrapping means 12. This has the advantage that the opening 22 of the wrapping means 12 is kept in shape, even if the wrapping means 12 is designed in form of a foil. The opening 22 and the mesh 26 are covered by a lid 28, which is designed integrally with the wrapping means 12, by extending the wrapping means 12 over the opening 22 and the mesh 26, and closing the opening 22, for example by welding the wrapping means 12 together. The integrally designed lid 28 may be removed by tearing the lid 28 of the wrapping means 10 and thus reopening the opening 22 and allowing a fluid to access the solid product block 14 through the opening 22.

Figure 5:
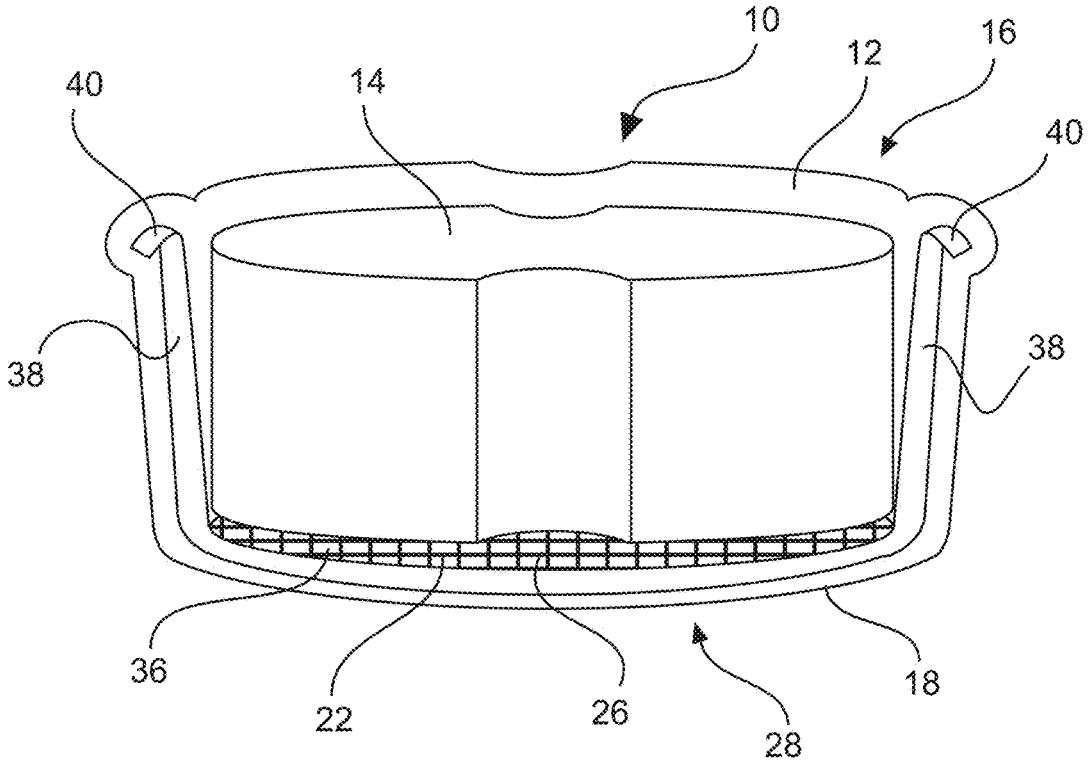
FIG. 5 illustrates a product packaging with a mesh in form of a product carrier.

The product packaging 10 comprising a mesh 26 in form of a product carrier 36 is displayed in FIG. 5. The product carrier 36 is designed to accommodate the solid product block 14, wherein for handling the product packaging 10 and/or the solid product block 14, the product carrier 36 comprises two handling means 38. The handling means 38 are arranged at opposite sides of the product carrier 36, wherein the handling means 38 extend from the mesh 26, the product carrier 36, which is arranged at the bottom 18 of the wrapping means 12 along the side 20 to the top 16 of the wrapping means 12. The handling means 38 each comprise a hook-shaped end 40 which allows a person to safely handle the product packaging 10 and the solid product block 14, especially after the solid product block 14 has been removed from the wrapping means 12, which in a transportation state encloses the solid product block 14 and the product carrier 36 with the handling means 38. The lid 28 may be formed integrally with the wrapping means 12, wherein at least part of the wrapping means 12 may be designed in form of a fluid soluble foil. Thus, the user may place the product packaging 10 containing the solid product block 14 into a dispenser without having to remove the lid 28. Once the operation of the dispenser starts, for example the spraying and/or flushing of the solid product block 14, the fluid soluble part of the wrapping means 12 forming the lid 28 is dissolved, which is equivalent to the lid 28 being removed, and the fluid may access the solid product block 14 through the mesh 26 and the opening 22 in order to generate an use solution. The bottom 18 of the product packaging 10 may be designed in form of a fluid soluble foil, thus forming a lid integrally formed with the wrapping means 12. This allows the fluid used for spraying the solid product, after the fluid soluble part of the wrapping means 12 has been dissolved, to contact the soluble product block 14 through the opening 22 and the mesh 26, thus dissolving the solid product.

The particular combinations of elements and features in the above detailed embodiments are exemplary only; the interchanging and substitution of these teachings with other teachings in this application is also expressly contemplated. As those skilled in the art were recognized, variations, modifications, and other implementations of what is described herein can occur to those of ordinary skill in the art without departing from the spirit and the scope of the invention as claimed. Accordingly, the foregoing description is by the way of example only and is not intended as limiting. In the claims, the wording comprising does not exclude other elements or steps, and the identified article "a" or "an" does not exclude a plurality. The mere fact that certain measures are recited and mutually different depending claims does not indicate that a combination of these measures cannot be used to advantage. The inventions scope is defined in the following claims and the equivalence thereto. Furthermore, reference signs used in the description and claims do not limit the scope of the invention as claimed.

LIST OF REFERENCE NUMERALS

10 product packaging
12 wrapping means
14 solid product block
16 top
18 bottom
20 sides
22 opening
24 top surface
26 mesh
28 lid
30 sealing area
32 flange
34 mesh opening
36 product carrier
38 handling means
40 hook-shaped end

What is claimed is:

1. A product packaging in combination with a dispenser system having a solid product block formed of a chemical cleaning agent, comprising:

a wrapping means comprising a top, sides, and a bottom, forming a cavity with an opening at least partially matching the size of the solid product block, and configured and arranged to receive the solid product block;

a mesh covering the opening, wherein said mesh comprises a flexible foil; and a lid attached removably to the mesh in a closed position for sealing the opening of the wrapping means;

wherein the opening, the mesh and the lid are located at the bottom of the wrapping means, and wherein the lid is an at least partially fluid soluble foil.

2. The product packaging according to claim 1, characterised in that the mesh comprises a fluid impermeable shrink wrapped foil.

3. The product packaging according to claim 1, characterised in that the mesh is generated by laser cutting, particularly in an assembled position of the mesh attached to the wrapping means.

4. The product packaging according to claim 1, characterised in that the wrapping means comprises a flange for attaching the mesh or the lid.

5. The product packaging according to claim 1, characterised in that the mesh located at the bottom of the wrapping means is designed in form of a product carrier comprising at least one handling means.

6. The product packaging according to claim 5, characterised in that the at least one handling means comprises a hook-shaped end.

7. The product packaging according to claim 1, characterised in that the mesh and/or the lid are formed integrally with the wrapping means.

8. The product packaging according to claim 1 further comprising mesh openings in the mesh.

* * * * *